US008302885B2

(12) United States Patent
Juo

(10) Patent No.: US 8,302,885 B2
(45) Date of Patent: Nov. 6, 2012

(54) SPRAYER WITH AN IMPROVED SPRAYING STRUCTURE

(75) Inventor: Chung-Tsuen Juo, Taichung (TW)

(73) Assignee: Victor Air Tools Co., Ltd., Taichung County (TW)

( * ) Notice: Subject to any disclaimer, the term of this patent is extended or adjusted under 35 U.S.C. 154(b) by 280 days.

(21) Appl. No.: 12/877,315

(22) Filed: Sep. 8, 2010

(65) Prior Publication Data

US 2012/0056015 A1 Mar. 8, 2012

(51) Int. Cl.
*B05B 9/00* (2006.01)

(52) U.S. Cl. ..... 239/379; 239/406

(58) Field of Classification Search ..... 239/379, 239/376, 377, 406, 418, 434, 600
See application file for complete search history.

(56) References Cited

U.S. PATENT DOCUMENTS

| | | | | |
|---|---|---|---|---|
| 6,012,651 | A * | 1/2000 | Spitznagel | 239/345 |
| 6,536,684 | B1 * | 3/2003 | Wei | 239/302 |
| 6,712,292 | B1 * | 3/2004 | Gosis et al. | 239/345 |
| 7,036,752 | B1 * | 5/2006 | Hsiang | 239/379 |
| 7,731,104 | B2 * | 6/2010 | Peterson et al. | 239/279 |
| 7,837,132 | B2 * | 11/2010 | Mazooji et al. | 239/263.1 |

* cited by examiner

*Primary Examiner* — Davis Hwu
(74) *Attorney, Agent, or Firm* — Rosenberg, Klein & Lee

(57) ABSTRACT

A sprayer with an improved spraying structure comprises a body, a nozzle, a knob, and a nozzle sleeve. The body has a passage and a valve. At the end of the passage is an air outlet. A mounting part with an insertion hole is provided around the body. The assembly of the nozzle, the knob, and the nozzle sleeve is inserted in the mounting part. The paint bottle with paint is connected to the knob.

9 Claims, 7 Drawing Sheets

SPRAYER WITH AN IMPROVED SPRAYING STRUCTURE

BACKGROUND OF THE INVENTION

1. Field of Invention

The invention relates to a sprayer and, in particular, to a sprayer with an improved spraying structure.

2. Related Art

FIG. 6 shows a conventional sprayer. It includes a body 8 that has an air passage 80 for a high-pressure gas to follow through. The end of the air passage 80 is an air outlet 81. The middle of the air passage 80 has a control valve 82. A handle 83 can be depressed to activate the control valve 82, thereby opening the air passage 80 for the high-pressure gas to be ejected via the air outlet 81.

A mounting part 84 is provided on the body 8 near the air outlet 81. A through hole 85 connected with the air outlet 81 is formed around the body 8. A nozzle 86 goes through the mounting part 84. The front end of the nozzle 86 is inserted into the through hole 85 and thus connected with the air outlet 81. A screw pin 840 screw-fastens the nozzle 86 on the mounting part 84. The rear end of the nozzle 86 is connected with a paint bottle 87. When the high-pressure gas flows through the air passage 80, the paint in ht paint bottle 87 is guided out by the high-pressure gas and sprayed on an object.

The nozzle 86 includes a fixing part 860 and an adjusting part 861. The fixing part 860 is connected to the outlet of the paint bottle 87. The front end of the fixing part is screw-fastened with the adjusting part 861. The front end of the adjusting part 861 has a paint outlet extended into the air outlet 81. By turning the adjusting part 861, one can adjust the flux of the paint ejected out of the adjusting part.

When assembling the sprayer, one has to insert the front end of the paint outlet of the adjusting part 861 into the through hole 85. After inserting the fixing part 860 through the mounting part 84, its front end goes into the adjusting part 861. The adjusting part 861 is turned in order to connect with the fixing part 860. The screw pin 840 on the mounting part 84 is screwed and locked. This completes the assembly of the sprayer. However, the nozzle 86 thereof needs to be cleaned very often. Moreover, the assembly procedure of this conventional sprayer is complicated. Therefore, it is not an easy task to clean the nozzle 86. The space for the adjusting part 861 on the inner side of the mounting part 84 is limited. Thus, such a conventional sprayer has the problem in adjusting the ejected flux of paint.

FIG. 7 shows another conventional sprayer whose primary components are roughly the same as the previous one. It includes a body 9, a mounting part 90, and a nozzle 91. A main difference is in that the mounting part 90 of the body 9 has a notch 900 (see FIG. 8). To assemble the nozzle 91 with the body 9, one only needs to put the notch 900 into the mounting part 90. However, the adjusting part 910 of the nozzle 91 still has a limited space. In addition to the fact that it is difficult for the user to exert a force as his fingers turn the adjusting part 910, the front end of the adjusting part 910 shifts back and forth in the air outlet 92 of the body 9 at the same time. Such a shift in position is likely to change the size of the spraying are. If the user does not test beforehand, it is very possible to result in a failure.

The invention thus aims at providing a solution to the above-mentioned problems.

SUMMARY OF THE INVENTION

An objective of the invention is to provide a sprayer with an improved spraying structure. Its nozzle can be taken off of the body along with a nozzle sleeve. Therefore, after each spraying task, the user can quickly and conveniently take off the nozzle and nozzle sleeve for cleaning.

Another objective of the invention is to provide sufficient space on the sprayer for the convenience of holding the knob with fingers. It is thus easier to adjust the paint flux out of the sprayer.

A further objective of the invention is to fix the nozzle sleeve on the mounting part of the body in the disclosed sprayer. Therefore, the second paint outlet at the front end of the nozzle sleeve can aim at the air outlet in front of the air outlet and get positioned. This avoids mistakes during paint spray due to the shift of the paint outlet. The invention thus saves a lot of time in adjustments.

To achieve the above-mentioned objectives, the invention includes: a body, a nozzle, and a nozzle sleeve.

The body has a first passage inside with a valve to control the passage of a high-pressure gas. The first passage forms an air outlet at the front end of the body. A mounting part is provided around the body in the vicinity of the air outlet. The mounting part has an insertion hole toward the air outlet.

The front end of the nozzle has a conic shape. Inside the nozzle is a passage for paint to flow through. The passage has a first paint outlet at the front end of the nozzle for releasing paint. The nozzle has a knob on the other end of the first paint outlet. The knob is located on the outer side of the mounting part and drives the nozzle to rotate simultaneously. The other end of the knob on the nozzle can be connected with a paint bottle for the paint to flow out of the first paint outlet via the passage of the nozzle.

The nozzle sleeve has a second passage inside. The front end of the nozzle sleeve has a second paint outlet connected with the second passage. The nozzle is screwed to the nozzle sleeve in the second passage. The first paint outlet connects to the second paint outlet inside the nozzle sleeve. The knob is exposed outside the nozzle sleeve. The nozzle shifts axially in the nozzle sleeve with the turn of the knob. The front end of the conic shape adjusts the paint flux through the second paint outlet. The nozzle sleeve goes through the insertion hole of the mounting part. The second paint outlet at the front end of the nozzle sleeve is positioned in front of the air outlet and aligned with the center thereof. The nozzle sleeve can be withdrawn from the insertion hole of the mounting part.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

The present invention will be apparent from the following detailed description, which proceeds with reference to the accompanying drawings, wherein the same references relate to the same elements.

Figure 1:
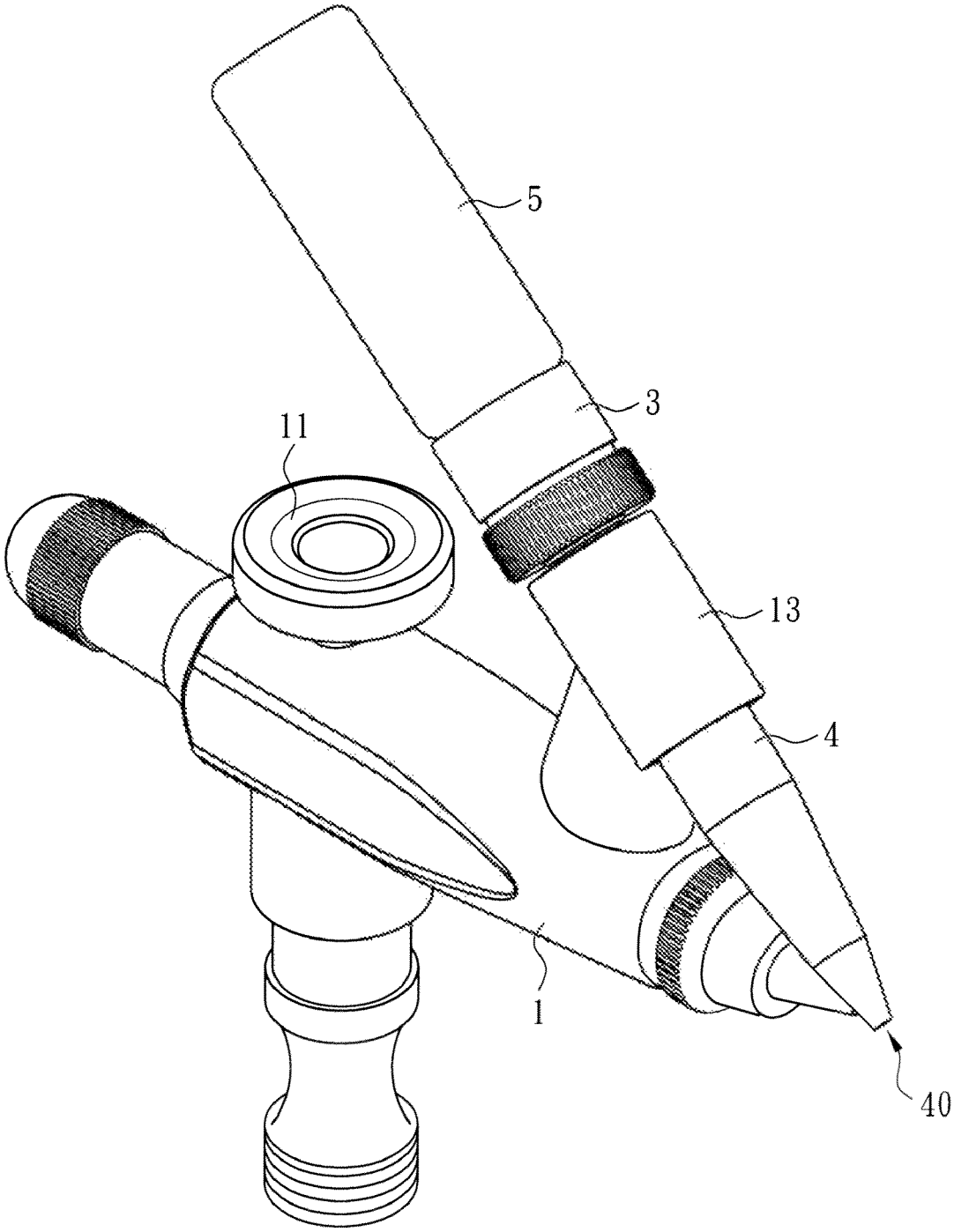
FIG. 1 is a three-dimensional view of the invention.
Figure 2:
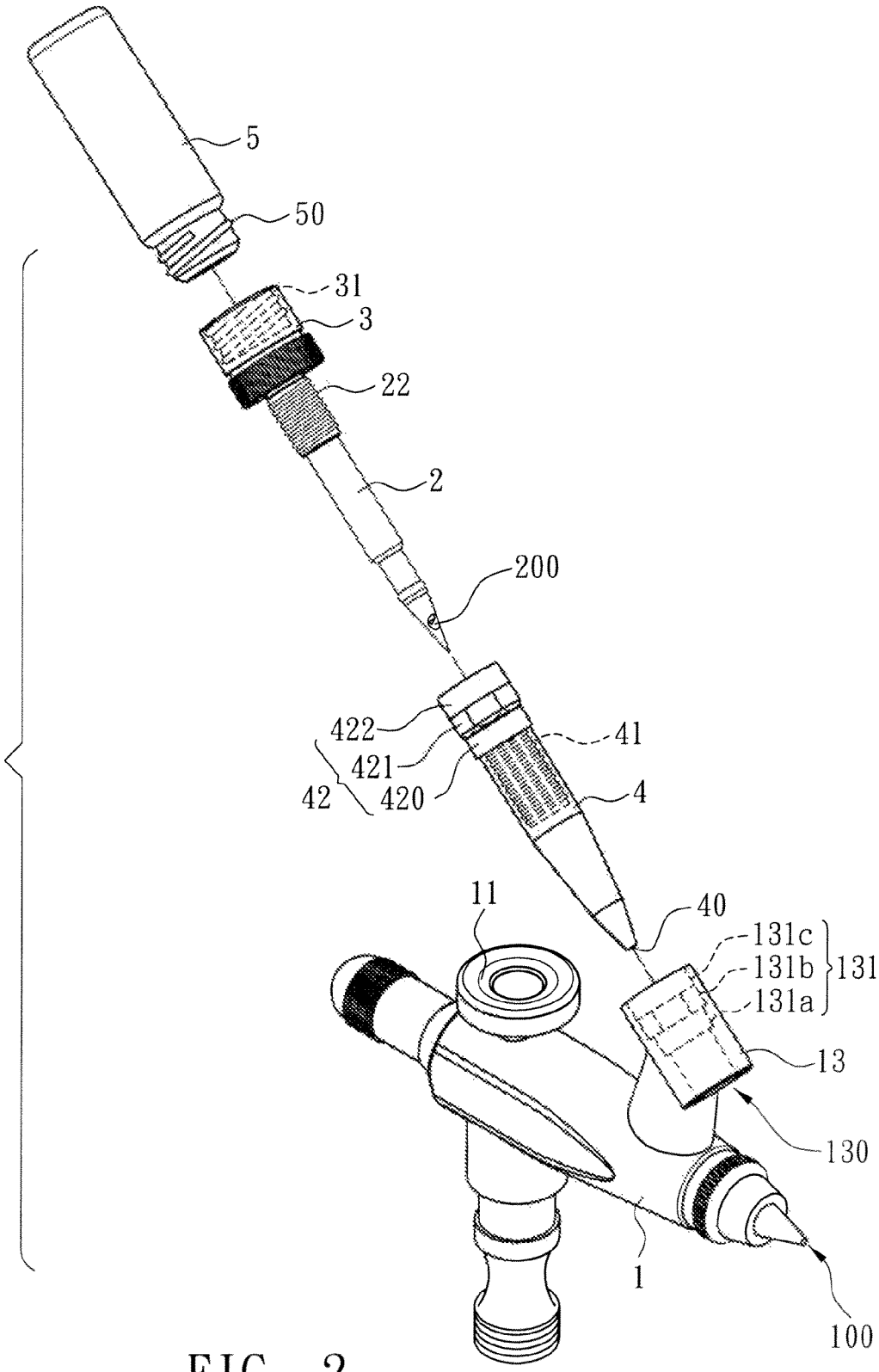
FIG. 2 is an exploded view of the invention.

The invention provides a sprayer with an improved spraying structure. As shown in FIGS. 1 and 2, a preferred embodiment of the invention includes a body 1, a nozzle 2, a knob 3, and a nozzle sleeve 4. After a paint bottle 5 is mounted, one can use it to perform a praying task.

Figure 3:
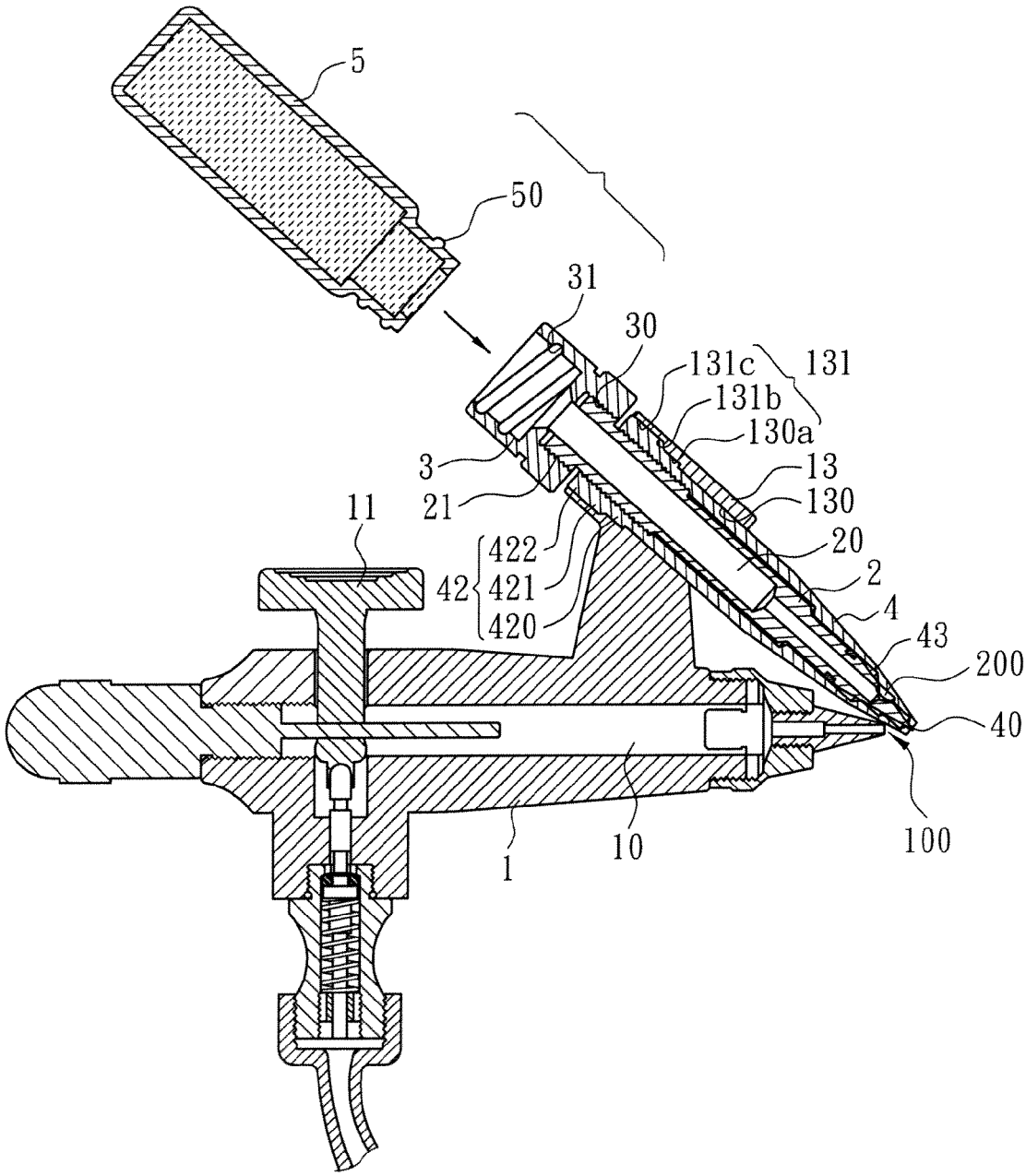
FIG. 3 is a cross-sectional view of the invention.

As shown in FIG. 3, the body 1 has a first passage 10 inside. The first passage 10 forms an air outlet 100 at the front end of the body 1. A high-pressure gas is externally provided to enter the first passage 10. A valve 11 is provided in the middle of the first passage 10 to control the openness of the first passage 10. The high-pressure gas is thus controlled to flow in the body 1 and output via the air outlet 100.

As shown in FIGS. 1 to 3, a mounting part 13 is provided around the body 1 in the vicinity of the air outlet 100. The mounting part 13 has an insertion hole 130 toward the air outlet 100. In this embodiment, the mounting part 13 and the body 1 are integrally formed. The diameter of the insertion hole 130 gradually shrinks toward the air outlet 100. Of course, the mounting part 13 can be an independent component to be assembled onto the body 1.

As shown in FIGS. 2 and 3, the front end of the nozzle 2 has a conic shape. The nozzle 2 has a passage 20 for the paint in the paint bottle 5 to flow through. The passage 20 has a first paint outlet 200 at the front end of the nozzle 2 for the paint to flow out.

As shown in FIGS. 2 and 3, the nozzle 2 is provided with the knob 3 on the other end of the first paint outlet 200. The knob 3 is on the outer side of the mounting part 13 and away from the air outlet 100. As the knob 3 turns, the nozzle 2 is driven to rotate simultaneously. The paint bottle 5 is connected to the knob 3 and on the other end of the nozzle 2.

In this embodiment, the knob 3 and the nozzle 2 are independent components. The knob 3 is locked to the end portion of the nozzle 2. The knob 3 has female threads 30, 31 on its two ends. The end portion of the nozzle 2 has a male thread 21 for one female thread 30. The opening of the paint bottle 5 has another male thread 50 for the other female thread 31. Besides, the knob 3 can be integrally formed with the nozzle 2.

Figure 4:
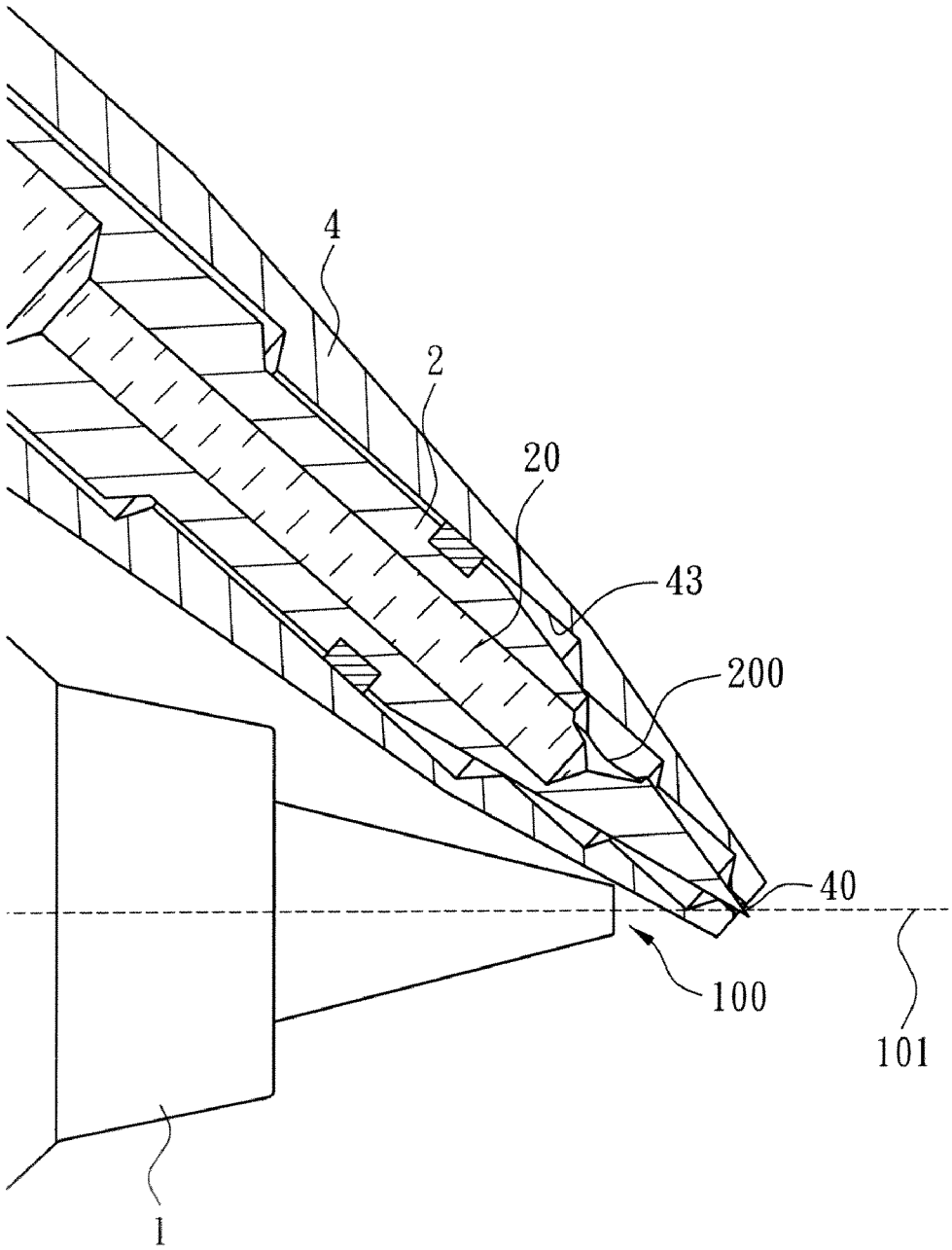
FIG. 4 is a locally enlarged view of the front end of the body.

As shown in FIGS. 2 and 3, the nozzle sleeve 4 has a second passage 43 inside. The front end of the nozzle sleeve 4 has a second paint outlet 40. The second paint outlet 40 is in communications with the second passage 43. The nozzle 2 is screwed to the nozzle sleeve 4 in the second passage 43. The first paint outlet 200 is in communications with the second paint outlet 40 in the second passage 43 of the nozzle sleeve 4. The knob 3 is exposed outside the nozzle sleeve 4. In this embodiment, the nozzle 2 has a male thread 22, and the nozzle sleeve 4 has a corresponding female thread 41. The nozzle 2 and the nozzle sleeve 4 are thus locked via the male thread 22 and the female thread 41. The nozzle 2 can shift axially in the second passage 43 of the nozzle sleeve 4 with the turn of the knob 3. The front end of the conic shape adjusts the paint flux out of the second paint outlet 40. Note that the second paint outlet 40 can go from completely open to completely closed. In other words, one can turn the knob 3 to adjust the space between the first paint outlet 200 and the second paint outlet 40. The paint flux becomes larger (smaller) if the space is larger (smaller). As shown in FIG. 4, when the spraying task is done, one can close the second paint outlet 40 at the front end of the nozzle 2. The paint is thus sealed inside the nozzle sleeve 4 and prevented from dry out.

When the nozzle sleeve 4 is combined with the body 1, it goes through the insertion hole 130 of the mounting part 13. The second paint outlet 40 at the front end of the nozzle sleeve 4 is positioned in front of the air outlet 100. The nozzle sleeve 4 can be withdrawn from the insertion hole 130 of the mounting part 13. As shown in FIG. 4, the first passage 10 of the body 1 defines an axis 101 through the center of the air outlet 100. The second paint outlet 40 of the nozzle sleeve 4 falls on the axis 101. That is, the second paint outlet 40 aligns with the center of the air outlet 100. Therefore, the paint out of the second paint outlet 40 can be ejected accurately and stably.

As shown in FIGS. 2 and 3, the nozzle sleeve 4 in this embodiment has a stopping part 42 on the other end of the second paint outlet 40. The mounting part 13 has a groove part 131 corresponding to the stopping part 42. The diameter of the groove part 131 is slightly larger than the insertion hole 130. As shown in the drawing, the stopping part 42 and the groove part 131 have corresponding shapes, so that the stopping part 42 is stopped inside the groove part 131 to prevent the nozzle sleeve 4 from rotating with respect to the mounting part 13. In this embodiment, the stopping part 42 consists of the nozzle sleeve 4 connected in sequence with a small-diameter section 420, an engaging section 421, and a large-diameter section 422. The surroundings of the small-diameter section 420 and the large-diameter section 422 have annular shapes. The surrounding of the engaging section 42 is hexagonal. The groove part 131 has a small-diameter groove 131*a*, an engaging groove 131*b*, and a large-diameter groove 131*c* corresponding to the stopping part 4. The small-diameter groove 131*a* and the large-diameter groove 131*c* also have annular shapes. The engaging groove 131*b* is hexagonal corresponding to the engaging section 421. The small-diameter section 420, the engaging section 421, and the large-diameter section 422 of the stopping part 42 are accommodated in the small-diameter groove 131*a*, the engaging groove 131*b*, and the large-diameter groove 131*c* of the groove part 131, respectively. With the small-diameter section 420 and the large-diameter section 422 placed in the small-diameter groove 131*a* and the large-diameter groove 131*c*, the engaging section 421 is firmly positioned in the engaging groove 131*b*.

Moreover, the outside of the nozzle sleeve 4 has a slope corresponding to the shrinking diameter of the insertion hole 130. When the nozzle sleeve 4 is inserted into the shrinking insertion hole 130, it is fixed in the mounting part 13.

According to the above-mentioned structure, the nozzle 2 and the nozzle sleeve 4 are locked in the assembly of the sprayer. The knob 3 is fixed on the nozzle 2. The nozzle sleeve 4 is then inserted into the insertion hole 130 of the mounting part 13, no that the front end of the nozzle sleeve 4 is in front of the air outlet 100. The second paint outlet 40 aligns with the air outlet 100. The paint bottle 5 is locked onto the knob 3 via the male thread 50 and the female thread 31. This completes the assembly of the disclosed sprayer.

Figure 5:
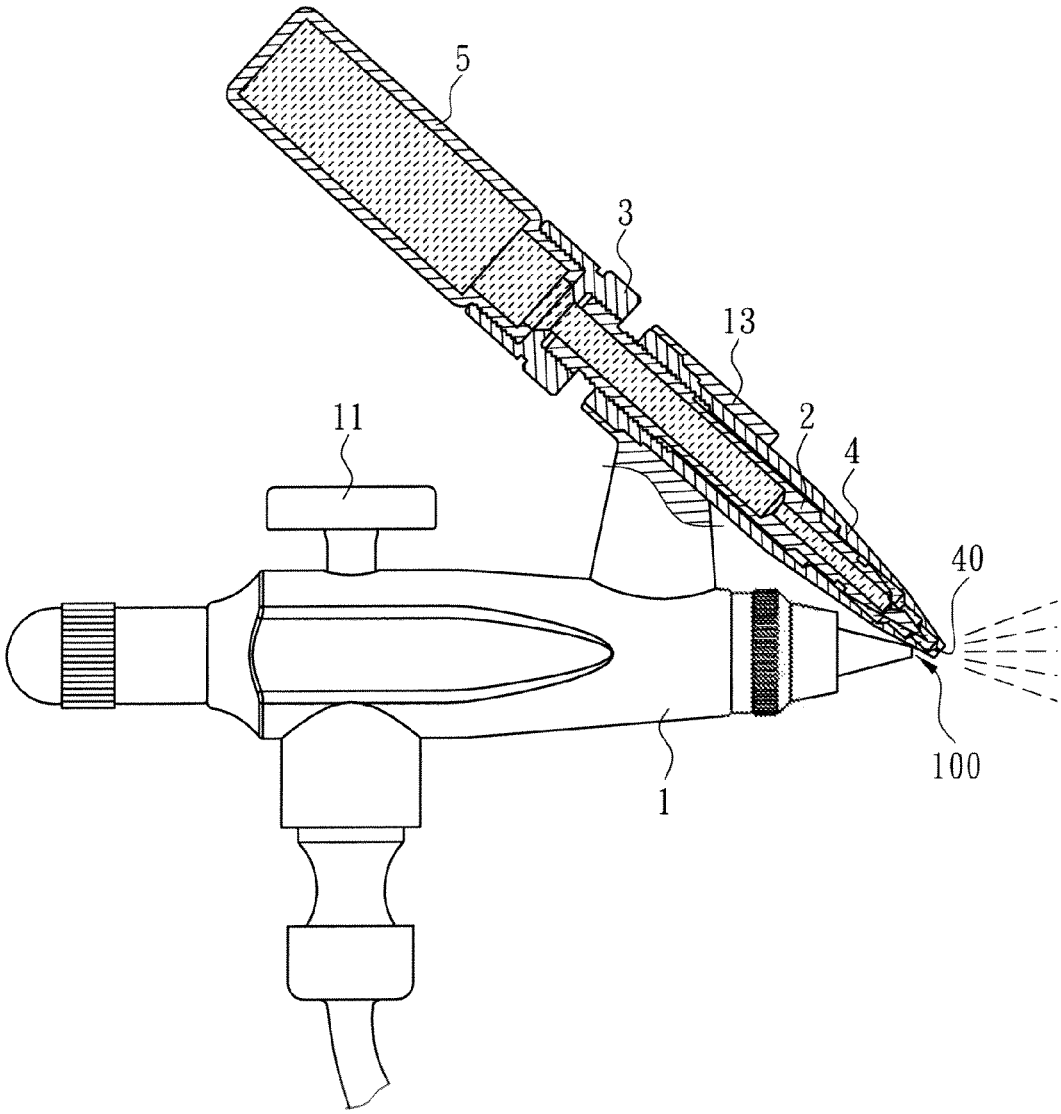
FIG. 5 is a schematic view of spraying using the invention.
Figure 6:
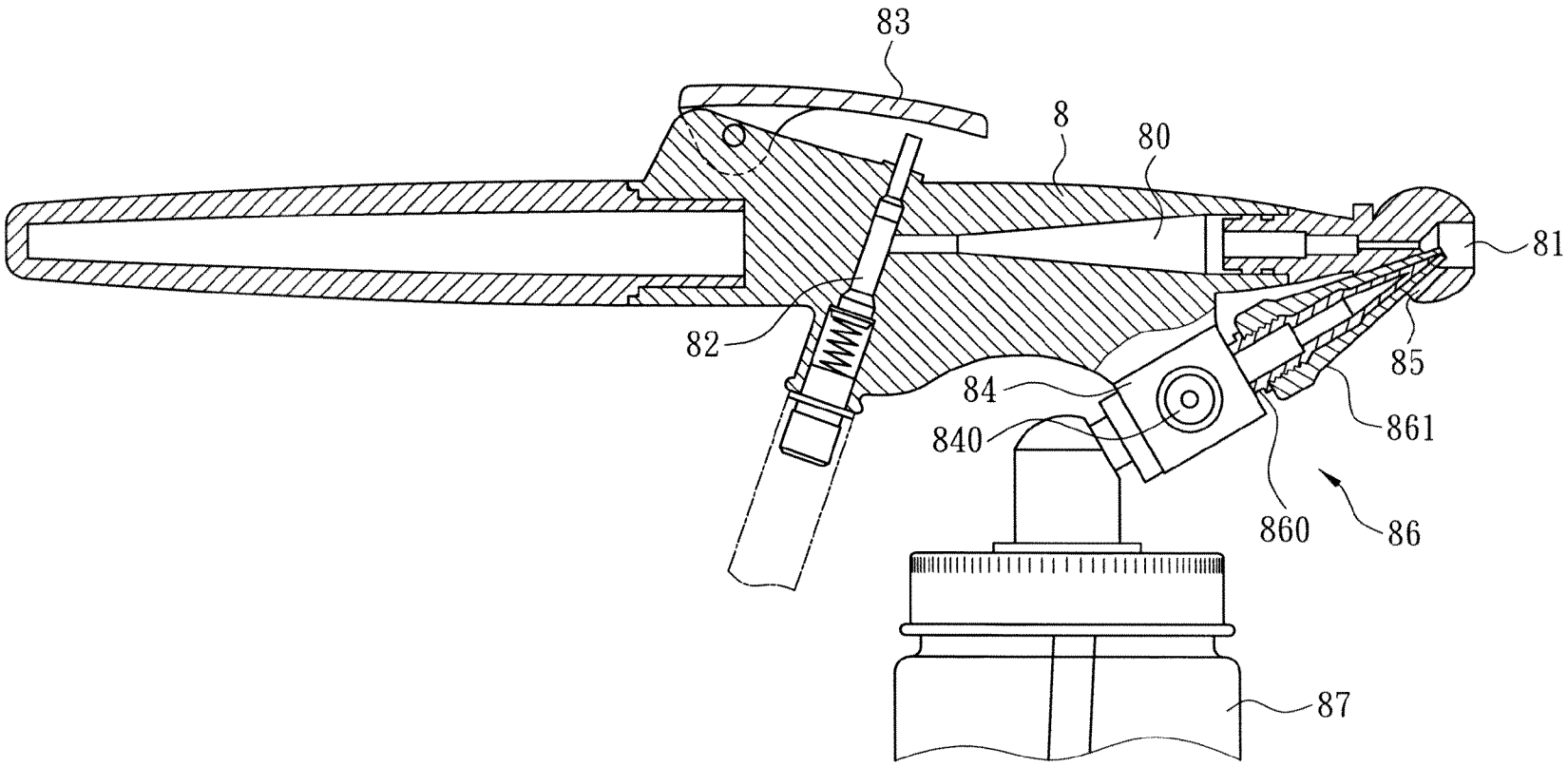
FIG. 6 PRIOR ART
FIG. 6 is a cross-sectional view of the first conventional sprayer.
Figure 7:
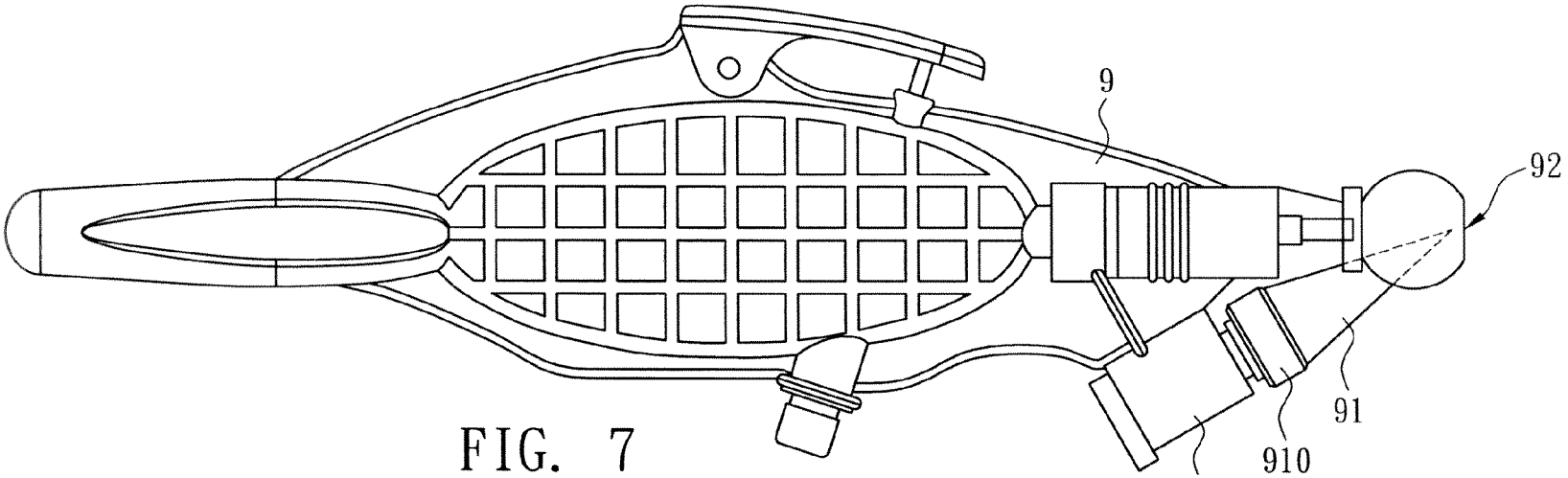
FIG. 7 PRIOR ART
FIG. 7 is a cross-sectional view of the second conventional sprayer.
Figure 8:
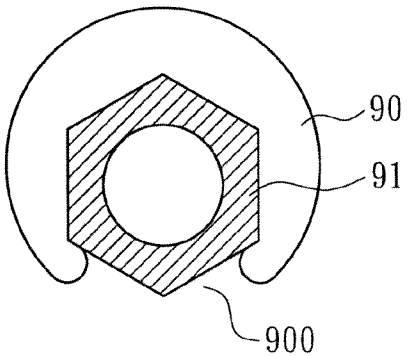
FIG. 8 PRIOR ART
FIG. 8 shows the notch at the mounting part in the second conventional sprayer.

As shown in FIG. 5, after the body 1 is connected with an external high-pressure gas source, the high-pressure gas enters via the passage 10 of the body 1. It then flows to the air outlet 100 under the control of the valve 11. The paint in the paint bottle 5 flows out of the first paint outlet 200 of the nozzle 2. With the control of the knob 3 on the paint flux, the paint is blown out of the air outlet 100 by the high-pressure gas via the second paint outlet 40.

If the user wants to clean the sprayer after finishing a spraying task, he only needs to withdraw the nozzle sleeve 4 from the insertion hole 130 of the mounting part 13. Afterwards, the nozzle 2 is taken off of the nozzle sleeve 4. The nozzle 2 and the paint bottle 5 are released from the knob. Then the various spraying components can be cleaned separately.

It is apparent from the above description that the advantages of the invention are:

1. The nozzle 2 is locked on the nozzle sleeve 4 in the invention. To disassemble the sprayer, one simply takes off the nozzle sleeve 4 of the insertion hole 130 of the mounting part 13, followed by taking off the nozzle 2, the knob 3, and the paint bottle 5. Therefore, after each painting task, the user can quickly take off each spraying component and clean them. The cleaning is thus made easy.

2. The knob 3 of the invention is above the mounting part 13, instead of below it as in the prior art. Therefore, when adjusting the flux of the paint, there is sufficient space for the user's fingers to manipulate the knob 3. Therefore, the paint flux adjustment is more accurate and more convenient.

3. The disclosed sprayer has the nozzle sleeve 4 fixed in the insertion hole 130 of the mounting part 13. After the nozzle sleeve 4 is fixed, the second paint outlet 40 at its front has a fixed position in the air outlet 100 of the body 1. This prevents any shift of the second paint outlet 40. As a benefit, the invention can avoid possible mistakes due to changes in the spraying area and save time of making adjustments for such mistakes.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. A sprayer with an improved spraying structure, comprising:

a body having a first passage inside, wherein the first passage is controlled by a valve for a high-pressure gas to flow through and forms an air outlet at the front end of the body, a mounting part is provided around the body in the vicinity of the air outlet, and the mounting part has an insertion hole toward the air outlet;

a nozzle having a conic shape at the front end and a passage for paint to flow through, wherein the passage has a first paint outlet on the front end of the nozzle, a knob is provided on the other end of the nozzle on the outer side of the mounting part to drive the nozzle to rotate simultaneously, the other end of the knob is connected with a paint bottle containing the paint, and the paint flows through the passage to output from the first paint outlet;

a nozzle sleeve having a second passage inside, wherein the front end of the nozzle sleeve has a second paint outlet in communications with the second passage, the nozzle is screwed onto the nozzle sleeve in the second passage, the first paint outlet is in communications with the second paint outlet in the nozzle sleeve, the knob is exposed from the nozzle sleeve so that the nozzle shifts axially in the nozzle sleeve as the knob turns, the conic front end adjusts the paint flux out of the second paint outlet, the nozzle sleeve goes through the insertion hole of the mounting part, the second paint outlet at the front end of the nozzle sleeve is positioned in front of the air outlet and aligned with the center thereof, and the nozzle sleeve is removable from the insertion hole of the mounting part.

2. The sprayer with an improved spraying structure of claim 1, wherein the other end of the nozzle sleeve from the second paint outlet has a stopping part and the mounting part has a groove part corresponding to the stopping part and having a larger diameter, and the stopping part and the groove part have the corresponding shapes to stop against each other, thereby preventing the nozzle sleeve from rotating with respect to the mounting part.

3. The sprayer with an improved spraying structure of claim 2, wherein the stopping part consists of the nozzle sleeve connected in sequence a small-diameter section, an engaging section, and a large-diameter section with an annular shape around the small-diameter section and the large-diameter section and a hexagonal shape around the engaging section, the groove part has a small-diameter groove, an engaging groove, and a large-diameter groove corresponding to the stopping part with an annular shape for the small-diameter groove and the large-diameter groove and a hexagonal shape for the engaging groove, and the small-diameter section, the engaging section and the large-diameter section the stopping part are accommodated in the small-diameter groove, the engaging groove and the large-diameter groove of the groove part, respectively.

4. The sprayer with an improved spraying structure of claim 1, wherein the diameter of the insertion hole gradually shrinks toward the through hole and the outer diameter of the nozzle sleeve has a corresponding slope so that the nozzle sleeve is fixed in the mounting part as the nozzle sleeve is inserted into the shrinking insertion hole.

5. The sprayer with an improved spraying structure of claim 1, wherein the knob is locked to the end portion of the nozzle.

6. The sprayer with an improved spraying structure of claim 1, wherein the mounting part and the body are integrally formed.

7. The sprayer with an improved spraying structure of claim 1, wherein the mounting part is an independent component to be assembled to the body.

8. The sprayer with an improved spraying structure of claim 1, wherein the knob and the nozzle are integrally formed.

9. The sprayer with an improved spraying structure of claim 1, wherein the knob and the nozzle are independent components.

* * * * *